US007422071B2

(12) United States Patent
Wilkie et al.

(10) Patent No.: US 7,422,071 B2
(45) Date of Patent: Sep. 9, 2008

(54) SWELLING PACKER WITH OVERLAPPING PETALS

(75) Inventors: Arnold E. Wilkie, Merritt Island, FL (US); Jeffrey S. Haggard, Cocoa, FL (US)

(73) Assignee: Hills, Inc., West Melbourne, FL (US)

( * ) Notice: Subject to any disclaimer, the term of this patent is extended or adjusted under 35 U.S.C. 154(b) by 8 days.

(21) Appl. No.: 11/326,212

(22) Filed: Jan. 5, 2006

(65) Prior Publication Data

US 2006/0272806 A1 Dec. 7, 2006

Related U.S. Application Data

(60) Provisional application No. 60/647,816, filed on Jan. 31, 2005.

(51) Int. Cl.
*E21B 33/127* (2006.01)

(52) U.S. Cl. ..... 166/387; 166/179; 166/187

(58) Field of Classification Search ..... 166/387, 166/179, 187
See application file for complete search history.

(56) References Cited

U.S. PATENT DOCUMENTS

| | | | | |
|---|---|---|---|---|
| 2,814,947 | A * | 12/1957 | Stegemeier et al. | 73/152.18 |
| 3,385,367 | A * | 5/1968 | Kollsman | 166/191 |
| 3,918,523 | A | 11/1975 | Stuber | |
| 4,137,970 | A | 2/1979 | Laflin et al. | |
| 4,524,982 | A * | 6/1985 | Hertz, Jr. | 277/322 |
| 4,612,985 | A | 9/1986 | Rubbo et al. | |
| 4,862,967 | A | 9/1989 | Harris | |
| 4,919,989 | A | 4/1990 | Colangelo | |
| 4,936,386 | A | 6/1990 | Colangelo | |
| 5,048,605 | A | 9/1991 | Toon et al. | |
| 5,195,583 | A | 3/1993 | Toon et al. | |
| 6,073,692 | A | 6/2000 | Wood et al. | |
| 6,581,682 | B1 * | 6/2003 | Parent et al. | 166/180 |
| 6,834,725 | B2 * | 12/2004 | Whanger et al. | 166/384 |
| 6,848,505 | B2 | 2/2005 | Richard et al. | |
| 6,854,522 | B2 | 2/2005 | Brezinski et al. | |
| 2004/0020662 | A1 | 2/2004 | Freyer | |
| 2004/0055760 | A1 | 3/2004 | Nguyen | |
| 2004/0118572 | A1 | 6/2004 | Whanger et al. | |
| 2004/0194971 | A1 | 10/2004 | Thomson | |

(Continued)

FOREIGN PATENT DOCUMENTS

| | | |
|---|---|---|
| JP | 04/363499 | 12/1992 |

(Continued)

*Primary Examiner*—William P Neuder
(74) *Attorney, Agent, or Firm*—Edell, Shapiro & Finnan, LLC

(57) ABSTRACT

A packer for downhole use features interacting elements of swelling material. Preferably the elements are in contact for relative movement from an initial diameter for run in. As the elements swell, they move with respect to each other to enlarge the diameter of the assembly so that a sealing contact is made. Each element exerts a residual force on the adjacent element to enhance the seal. Each element is preferably coated with a material that allows well fluids to reach the swelling material and then later to stiffen and become impervious from exposure to such fluids. The assembly can be covered for run in to delay the onset of expansion until the target depth is reached for the packer to be set.

29 Claims, 1 Drawing Sheet

U.S. PATENT DOCUMENTS

| | | | |
|---|---|---|---|
| 2004/0261990 | A1 | 12/2004 | Bosma et al. |
| 2005/0067170 | A1 | 3/2005 | Richard |
| 2005/0092363 | A1 | 5/2005 | Richard et al. |
| 2005/0110217 | A1 | 5/2005 | Wood et al. |
| 2005/0171248 | A1 | 8/2005 | Li et al. |

FOREIGN PATENT DOCUMENTS

| | | | |
|---|---|---|---|
| JP | 09/151686 | | 6/1997 |
| WO | WO 2004/018836 | A1 | 3/2004 |

* cited by examiner

SWELLING PACKER WITH OVERLAPPING PETALS

PRIORITY INFORMATION

This application claims the benefit of U.S. Provisional Application No. 60/647,816, filed on Jan. 31, 2005.

FIELD OF THE INVENTION

The field of this invention is packers that seal downhole annular spaces using a swelling action and more particularly where the seal is enhanced by interacting swelling components.

BACKGROUND OF THE INVENTION

Packers have been in use downhole to separate zones in a wellbore. Many styles of such packers have been used. Some mechanically compress a sealing element when the packer mandrel is properly positioned. The compression can be initiated with hydraulic pressure that is applied in the wellbore or the compression force can be initiated by taking advantage of available hydrostatic pressure that is allowed to act on a piston against a lower pressure chamber in the packer body. Some packers are inflatables that are actuated when properly positioned by applied pressure through a valving system leading to an annular space under the inflatable element. In general, these inflatables have a stationary end and a sliding collar at the opposite end of the element that rides up the mandrel as the element is inflated.

Other packers feature a sleeve of a material that swells that is mounted over a mandrel and covered by a protective material. The rationale is that the sleeve swells in contact with well fluids such as water or hydrocarbons. The outer cover is removable downhole so as to allow a predetermined time to deliver the packer to the desired position before the onset of swelling. Swelling that starts at a premature time could make it impossible to deliver the packer to the desired location or could result in sufficient damage to the sleeve during delivery that the resulting seal will either not occur or will fail under fairly low differential pressures. Some examples of prior art showing a swelling element with a delay feature to the swelling to allow delivery are: US 2004/0055760 A1; US 2004/0194971 A1; US 2004/0118572 A1; U.S. Pat. No. 4,862,967; U.S. Pat. No. 6,854,522; US 2004/0020662 A1; U.S. Pat. No. 3,918,523 and U.S. Pat. No. 4,612,985. Other designs involved putting a swelling material inside an inflatable element and some examples of such a design are: US 2005/0110217 A1; U.S. Pat. No. 6,073,692; U.S. Pat. No. 6,834,725; U.S. Pat. No. 5,048,605; U.S. Pat. No. 5,195,583 and Japan Application 07-334115. Some designs simply use an exposed element that begins to swell upon insertion with the idea that the swelling will progress slowly enough to allow enough time for the delivery to the desired location downhole. Some examples are: U.S. Pat. No. 6,848,505; PCT Application WO 2004/018836 A1; U.S. Pat. No. 4,137,970; US Application US 2004/0261990; Japan Application 03-166,459; U.S. Pat. Nos. 4,919,989 and 4,936,386; US Application US 2005/009363 A1; U.S. Pat. No. 6,854,522 and US Application US 2005/0067170 A1. Yet other design combine the swelling effect with swaging wherein the swelling member is held by a mechanical retainer for delivery and upon reaching the proper depth the expansion breaks the retainer or otherwise defeats it so that swelling can take place. This concept and many others focused on swaging to trigger packer setting are illustrated in U.S. Pat. No. 6,854,522 B2.

What are needed and not found in the above mentioned prior art are techniques that enhance the seal obtainable from a swelling material using the configuration of the sealing element working in conjunction with the swelling principle employed. Furthermore the invention provides not only an enhanced seal from component interaction but the design of the individual components themselves also promote longevity of the seal by better encapsulating the swelling material and using the encapsulating material for ultimate contact with a surrounding tubular or borehole for an improved seal. These and other advantages of the present invention will be more readily understood by those skilled in the art from the discussion of the preferred embodiment, the drawings and the claims, which determine the scope of the invention.

SUMMARY OF THE INVENTION

A packer for downhole use features interacting elements of swelling material. Preferably the elements are in contact for relative movement from an initial diameter for run in. As the elements swell, they move with respect to each other to enlarge the diameter of the assembly so that a sealing contact is made. Each element exerts a residual force on the adjacent element to enhance the seal. Each element is preferably coated with a material that allows well fluids to reach the swelling material and then later to stiffen and become impervious from exposure to such fluids. The assembly can be covered for run in to delay the onset of expansion until the target depth is reached for the packer to be set. The elements can be pivotally mounted to a mandrel where swelling initiates pivoting and sealing action.

BRIEF DESCRIPTION OF THE DRAWINGS

FIG. 1 shows, in section, the overlapping petals of swellable material in the small diameter position for run in;

DETAILED DESCRIPTION OF THE PREFERRED EMBODIMENT

Figure 1:
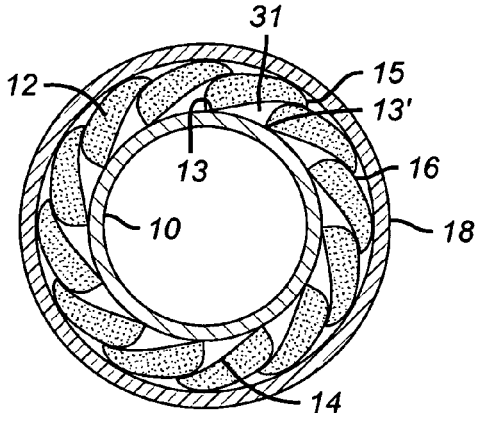
Figure 2:
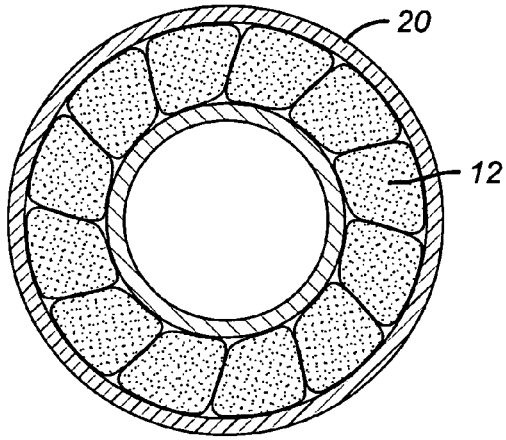
FIG. 2 is the view of FIG. 1 showing the petals swollen to a sealing position.

The packer of the preferred embodiment is shown in FIG. 1. It has a mandrel 10 that is surrounded by petals 12. In the preferred embodiment the petals 12 are crescent-shaped or arcuate in their contact surfaces to promote relative movement of one with respect to an adjacent petal as they swell. Preferably each petal has an end 13 that rests on the mandrel 10 with an opposite end 15 that overlays the end 13' of an adjacent petal 12. There is an initial gap 31 that closes as the elements 12 swell. The illustrated arrangement works similarly to an iris when swelling is initiated. Optionally the petals 12 can be retained as they swell with a band that grows with them (not shown) because of its elastic qualities or one that stretches and snaps at a given point of swelling. In that way the petals retain their relative positions better as they swell. The length can vary to suit the desired application. The cross-sectional shape can also vary and the contact surfaces during swelling do not need to be arcuate but could also be straight. Regardless of the cross-sectional shape, the interaction of the petals 12 upon swelling is to interact with each other so that the sealing force they ultimately provide is not simply defined solely by expansion that occurs during swelling. Rather, it is a combination of the dimension change from swelling as enhanced by the overlapping layout of the petals 12 that boosts the sealing force beyond that simply provided from mere swelling of a plurality of petals. A shape change for at least one of the petals 12 is contemplated as seen by comparing FIGS. 1 and 2. However, in the ultimate shape created, the adjacent petals 12 interact with each other when sealing is complete to enhance the force against the surrounding tubular or wellbore (not shown).

The petals 12 can preferably have an individual covering 14 that is preferably a resin coated initially porous bag. The bag initially lets well fluid though to the petal 12 to initiate its swelling process. The well fluids can be hydrocarbons, water or combinations thereof or other materials already in the wellbore or subsequently added to the wellbore after the mandrel 10 is placed in the desired location. Exposure to the particular fluid that made the petal 12 swell will eventually cure a resin material 16 that coats the bag 14. Alternatively, resin material 16 can be within the petal 12 and can set up as a given petal swells to increase the integrity of the ultimate seal. Alternatively the petal 12 can simply be coated with a resin or other material 16 that initially allows fluid to pass and with time and exposure to a fluid downhole cures or sets up or otherwise gets firm. In this manner there is no bag 14. The petals 12 can be made from an expandable material; examples of which are, a super absorbing polymer (SAP), gas producing water reactive materials, epoxy foams, etc. Possible hardenable materials include: Portland cement, water-hardenable urethane, alkyd, diisocyanate, etc. This material winds up being encased in bags 14 that desirably become impervious and more rigid so that they can seal against the borehole or surrounding tubular more effectively. The petals can be made of a variety of materials known to swell and the material selection can be tailored to the fluids expected in the well or those on hand to be introduced later. While multiple petals are contemplated, the invention further comprises other no-petal arrangements of a material that swells and hardens to form a downhole seal.

Figure 3:
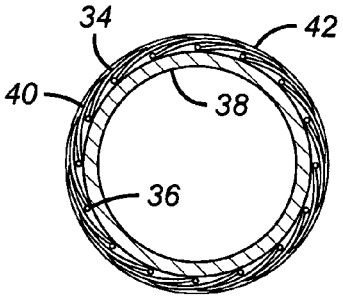
FIG. 3 is an alternative embodiment shown in section and in the run in position where curved wings are pivotally mounted to a mandrel and retracted.
Figure 4:
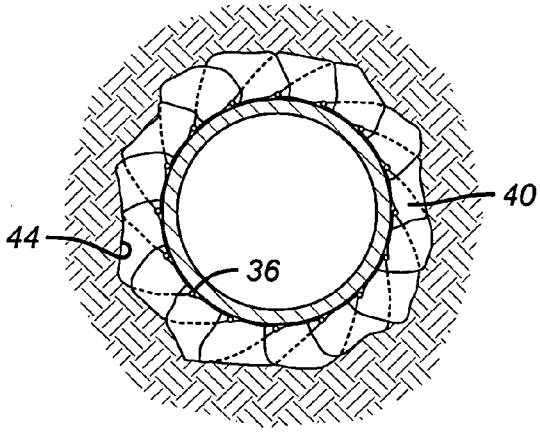
FIG. 4 is the view of FIG. 3 with the elements rotated out after swelling where the annular space is sealed.

The petals can also be mechanically reinforced to increase the pressure holding capacity, as illustrated in FIGS. 3 and 4. This can be done in many ways. Examples include: metal ribs hinged to the well pipe that are folded close to the pipe during run in then pivot out radially between the pipe and wellbore to strengthen the plug, fiber strands mixed with the expandable material, reinforcing cloth attached to the pipe that is folded close to the pipe during run in then unfolds when the expanding material grows to a position to strengthen the plug. Many other configurations are possible. Specifically, in FIG. 3 wings 34 that can be metal or another rigid material are connected at a pivot 36 mounted to the base pipe or mandrel 38. Each wing 34 supports an element 40 that can be attached to the wing 34 in a variety of ways. The wing can be enveloped by the element 40 or the element can be mounted on one side or the other of a particular wing 34. The element can be in the form of an expandable bag that surrounds a swelling material. In some instances the surrounding bag can initially allow well fluids or fluids added to the well to flow through it to initiate swelling within and thereafter harden to become more rigid and, possibly, impermeable. To allow time for run in before any swelling starts, an outer cover 42 can be applied over the elements 40 as a group or individually on one or more elements 40. This cover 42 protects the elements 40 during run in and also delays the advance of well fluid into the swellable material. Here again, the elements 40 when they swell, as shown in FIG. 4, take the shape of the annulus 44 and cause a pivoting motion about pivots 36 so that swelling elements 46 interact with each other to enhance the sealing force in the annular space 44. The presence of the wings simply increases the interaction effect of adjacent swelling elements 40. The bags or enclosures for the swelling material on the wings 34 can have reinforcing material such as fiberglass, Kevlar® or carbon fiber. The reinforcement allows better resistance to applied differential pressures after swelling has occurred and the annular space 44 is sealed. The swelling filler material can be water activated urethane or super absorbing polymer, for example. These materials swell when exposed to drilling fluids, for example. The outer cover 42 can be designed to slowly disappear in drilling fluid over a fairly long period of time with times as long as several days possible. Some possible materials for the cover 42 that can cover over all the elements 40 or some of them are PVA, EVOH or WSPET. Alternatively, the outer cover 42 can cover the elements 40 for run in but be porous to allow well fluids to reach the elements and have elastic capabilities to allow the swelling and then turn rigid from the well fluid exposure. Thus instead of or in addition to covering each element 40 individually with a cover that first passed fluid and then hardens, the assembly of all the petals or even groups of them can be similarly covered.

In operation the cover disappears after the assembly has been placed at the desired location. The wings 34 can make contact with the wellbore for sealing as acted upon by the elements 40. Depending on the configuration the elements 40 can make the seal on the wellbore wall reinforced by the wings 34 attached to them. Alternatively, a combination of contacting wings 34 or elements 40 doing the sealing is envisioned. The swellable material that is surrounded by a bag and defines an element 40 can also permeate the surrounding bag to help make it impervious by filling voids therein. The surrounding bag material can also harden and become more rigid to strengthen the overall performance of the assembly. A water activated urethane material on the bag can help the element 40 become harder to add sealing strength to the assembly.

Additionally, and optionally, an outer sheath 18 can be placed all around the coated bags 14 or individually around each or some of the bags 14. Doing this delays the access of the triggering fluid to the expandable material that preferably comprises the petals 12 until the assembly is properly located in the well. The sheath can be made of a material that dissolves over time in the well fluids or in other ways fails or goes away over time or with an applied force, such as expansion from within the mandrel with a swage, for example. Alternatively, there can be an outermost layer that delays the swelling action of the petals 12 that goes away by a variety of mechanisms, as stated above and just inside of it can be a porous flexible housing 20 that simply retains the petals 12 in an adjacent relationship as they swell. In this arrangement shown in FIG. 2 it is the housing 20 that will contact the wellbore or surrounding tubular (not shown) urged outwardly by the force from the expanding petals 12. The housing 20 can become impervious and/or get harder with exposure to well fluids. The arrangement of the petals 12 will enhance the sealing force as they swell and move relatively to each other to increase the contact force for sealing above and beyond the use of a simple cylindrical sleeve. The use of an initially porous material 16 to cover the petals 12 further improves the sealing capability of the assembly in that it maintains the structural integrity of the petals 12 that happen to be covered with the material 16.

The above description is illustrative of the preferred embodiment and many modifications may be made by those skilled in the art without departing from the invention whose scope is to be determined from the literal and equivalent scope of the claims below.

We claim:

1. A packer for downhole use, comprising:

a mandrel having a longitudinal axis;

a plurality of elements disposed on said mandrel in a plane transverse to said longitudinal axis and in initial contact with each other, said elements movable with respect to each other when actuated to swell for creating a seal downhole, wherein said relative movement enhances the seal formed by said elements and at least one of said elements is covered with a material that gets harder from contact with fluid that initially passes through it to initiate swelling of said element.

2. The packer of claim 1, wherein:

at least two of said elements move relatively to each other along an arcuate surface on at least one of said elements.

3. The packer of claim 1, wherein:

at least two of said elements overlay each other before swelling begins.

4. The packer of claim 1, wherein:

at least two of said elements move relatively to each other along a straight surface on at least one of said elements.

5. The packer of claim 1, wherein:

said material that gets harder comprises a resin that sets up and winds up in sealing contact downhole.

6. The packer of claim 1, wherein:

said elements are covered with a cover initially to isolate them from fluid that would initiate swelling.

7. The packer of claim 6, wherein:

said cover is removed downhole.

8. The packer of claim 7, wherein:

said cover is removed by dissolving in the fluid that triggers said elements to swell.

9. The packer of claim 7, wherein:

removal of said cover exposes a flexible housing that keeps said elements retained to each other as they swell to seal the borehole.

10. The packer of claim 1, wherein:

said elements define a space between adjacent elements that closes upon swelling.

11. The packer of claim 1, wherein:

said elements comprise super absorbing polymers.

12. The packer of claim 1, wherein:

said material that gets harder comprises a resin that sets up to make the swelled element more rigid.

13. A packer for downhole use, comprising:

a mandrel having a longitudinal axis;

a plurality of elements disposed on said mandrel in a plane transverse to said longitudinal axis and in initial contact with each other, said elements movable with respect to each other when actuated to swell for creating a seal downhole, wherein said relative movement enhances the seal formed by said elements, and at least one element pivots about a contact location with said mandrel due to swelling of an adjacent element.

14. The packer of claim 13, wherein:

said at least one element has an end opposite from said contact location that pivots away from said mandrel due to the swelling.

15. A packer for downhole use, comprising:

a mandrel having a longitudinal axis:

a plurality of elements disposed on said mandrel in a plane transverse to said longitudinal axis and in initial contact with each other, said elements movable with respect to each other when actuated to swell for creating a seal downhole, wherein said relative movement enhances the seal formed by said elements, and said elements comprise a reinforcing material.

16. The packer of claim 15, wherein:

said reinforcing material comprises staple fibers, such as: fiberglass, Kevlar fibers, carbon fibers, liquid crystal fibers.

17. The packer of claim 15, wherein:

the reinforcing material comprises a fabric.

18. A packer for downhole use, comprising:

a mandrel having a longitudinal axis;

a plurality of elements disposed on said mandrel in a plane transverse to said longitudinal axis and in initial contact with each other, said elements movable with respect to each other when actuated to swell for creating a seal downhole, wherein said relative movement enhances the seal formed by said elements, and hinged wings supporting said elements are attached to said mandrel that swing outward on said swelling, thus reinforcing the seal.

19. The packer of claim 18, wherein:

said wings are rigid and metallic.

20. The packer of claim 18, wherein:

said wings engage the wellbore for a seal upon swelling of said element.

21. The packer of claim 18, wherein:

said elements cover a wing associated with them.

22. A packer for downhole use, comprising:

a mandrel having a longitudinal axis:

a plurality of elements disposed on said mandrel in a plane transverse to said longitudinal axis and in initial contact with each other, said elements movable with respect to each other when actuated to swell for creating a seal downhole, wherein said relative movement enhances the seal formed by said elements; and a flexible housing that keeps said elements retained to each other as they swell to seal the borehole.

23. The packer of claim 22, wherein:

said flexible housing upon exposure to well fluids becomes harder.

24. The packer of claim 22, wherein:

said flexible housing is mounted over said elements.

25. The packer of claim 22, wherein:

said flexible housing upon exposure to well fluids becomes impervious.

26. A packer for downhole use, comprising:

a mandrel;

at least one element disposed on said mandrel, said element movable when actuated to swell for creating a seal downhole;

said element comprises a material that gets harder from contact with fluid that initiates swelling of said element.

27. The packer of claim 26, wherein:

said material surrounds said element.

28. The packer of claim 26, wherein:

said material is at least in part within said element.

29. The packer of claim 26, wherein:

said material comprises a resin.

* * * * *